US006873793B2

(12) United States Patent
Thweatt, Jr.

(10) Patent No.: US 6,873,793 B2
(45) Date of Patent: Mar. 29, 2005

(54) ELECTRIC WATER HEATER

(75) Inventor: Carlisle Thweatt, Jr., South Haven, MI (US)

(73) Assignee: Sherwood-Templeton Coal Company, Inc., Indianapolis, IN (US)

( * ) Notice: Subject to any disclaimer, the term of this patent is extended or adjusted under 35 U.S.C. 154(b) by 293 days.

(21) Appl. No.: 09/827,232

(22) Filed: Apr. 5, 2001

(65) Prior Publication Data

US 2002/0146244 A1 Oct. 10, 2002

(51) Int. Cl.[7] ..... F24H 1/10
(52) U.S. Cl. ..... 392/488; 219/546
(58) Field of Search ..... 352/488, 489, 352/487; 219/538, 544, 546, 548, 552

(56) References Cited

U.S. PATENT DOCUMENTS 4,182,948 A * 1/1980 Markum et al. ..... 219/458.1
4,924,069 A * 5/1990 Giordani ..... 392/485
5,963,580 A * 10/1999 Eckert ..... 219/523
5,978,550 A * 11/1999 Rochelle ..... 392/497

OTHER PUBLICATIONS

"Tubular Heaters", Ogden Manufacturing Co.*

* cited by examiner

*Primary Examiner*—Thor Campbell
(74) *Attorney, Agent, or Firm*—Price, Heneveld, Cooper, DeWitt & Litton

(57) ABSTRACT

An electrical heater for fluid including a generally tubular housing have a wall portion made of a titanium material, and an elongated electrical heating element having electrical connectors on opposite ends thereof extending through the wall portion. The electrical heating element has an outer sheath made of a titanium material, and an inner sheath made of a stainless steel material. The electrical heating element has an electrical resistance line disposed within the inner sheath and connected to the electrical connectors at opposite ends thereof. The electrical heating element includes a dielectric material disposed within the inner sheath around the electrical resistance line to facilitate heat transfer from the electrical resistance line to the inner sheath.

21 Claims, 2 Drawing Sheets

ELECTRIC WATER HEATER

BACKGROUND OF THE INVENTION

Electric flow-through water heaters are commonly employed for use in heating circulating water for use with a spa/hot tub and other applications. Electric flow-through water heaters commonly employ an electrical heating element disposed in a metallic vessel such that the heating element is in contact with the flow of water to provide heat exchange to the water as it flows along the heating element. In addition, a water pump is generally used to continuously circulate water through the heater vessel. In the conventional water heating system, a thermostat is typically disposed within the hollow of the vessel to sense the temperature of the heated water, and the heating element is generally controlled based on the sensed water temperature. According to many conventional approaches, the electric heater is controlled in response to the sensed temperature of the water to maintain a desired water temperature.

Modern pools, spas and the like may utilize a variety of chemicals in the water to prevent growth of bacteria or other undesirable organisms. Such chemicals may be highly reactive/corrosive, thus limiting the life of the heater element when exposed to the water and chemicals. Although stainless steel is corrosion resistant, the highly reactive nature of the chemicals degrades even known stainless steel heater elements. Known heater elements include a tubular stainless steel outer jacket with an inner conductive wire extending through the outer jacket. A dielectric insulation such as magnesium oxide or other suitable dielectric medium is disposed around the inner conductive wire to permit transfer of heat from the inner conductive wire to the outer jacket, while providing electrical insulation between the inner conductive wire and the outer jacket. The magnesium oxide or other powder is packed tightly to promote heat conduction from the inner conductive wire to the stainless outer jacket. In an attempt to alleviate the corrosion problems caused by the water and corrosive chemicals, a titanium outer sleeve material has been tried. However, the high temperatures of the heating element cause the titanium to stress relieve, thus significantly reducing the compaction and heat conduction capability of the magnesium oxide.

Accordingly, a heating element that alleviates the problems associated with prior heating elements would be desired.

SUMMARY OF THE INVENTION

One aspect of the present invention is an electrical heater for fluid including a generally tubular housing have a wall portion made of a titanium material, and an elongated electrical heating element having electrical connectors on opposite ends thereof extending through the wall portion. The electrical heating element has an outer sheath made of a titanium material, and an inner sheath made of a stainless steel material. The electrical heating element has an electrical resistance line disposed within the inner sheath and connected to the electrical connectors at opposite ends thereof. The electrical heating element includes a dielectric material disposed within the inner sheath around the electrical resistance line to facilitate heat transfer from the electrical resistance line to the inner sheath.

Another aspect of the present invention is an electrical heating element including an outer sheath made of a titanium material, and an inner sheath made of a stainless steel material. The electrical heating element has an electrical resistance line disposed within the inner sheath, the electrical heating element including a dielectric powder disposed within the inner sheath around the electrical resistance line. The outer sheath and the inner sheath are tightly rolled to compress the dielectric powder around the electrical resistance line.

Yet another aspect of the present invention is a method of fabricating an electrical heating element. The method includes providing an electrical resistance heating line, and placing the electrical resistance heating line in a stainless steel sheath. Dielectric powder is positioned around the electrical resistance heating line, and a titanium sheath is placed over the stainless steel sheath. The titanium and stainless steels sheaths are compacted to compress the dielectric powder around the heating line.

Yet another aspect of the present invention is an electrical heating element including an outer sheath made of a titanium material, and an inner sheath made of a stainless steel material. The electrical heating element has an electrical resistance line disposed within the inner sheath, the electrical heating element including a dielectric powder disposed within the inner sheath around the electrical resistance line. The outer sheath and the inner sheath are tightly rolled to compress the dielectric powder around the electrical resistance line. The outer sheath fits tightly around the inner sheath in a state of tensile hoop stress.

Yet another aspect of the present invention is a spa system including a container adapted to hold water for immersion of a user. The spa system also includes an electrical water heater, a pump, and a fluid conduit system interconnecting the container, electrical water heater, and the pump to permit fluid flow through the spa system. The electrical water heater includes a generally tubular housing having a wall portion made of a titanium material, and an elongated electrical heating element having electrical connectors on opposite ends thereof extending through the wall portion. The electrical heating element has an outer sheath made of a titanium material, and an inner sheath made of a stainless steel material. The electrical heating element has an electrical resistance line disposed within the inner sheath and connected to the electrical connectors at opposite ends thereof. The electrical heating element includes a dielectric material disposed within the inner sheath around the electrical resistance line to facilitate heat transfer from the electrical resistance line to the inner sheath.

These and other features, advantages, and objects of the present invention will be further understood and appreciated by those skilled in the art by reference to the following specification, claims, and appended drawings.

DETAILED DESCRIPTION OF PREFERRED EMBODIMENT

For purposes of description herein, the terms "upper," "lower," "right," "left," "rear," "front," "vertical,"

Figure 3:
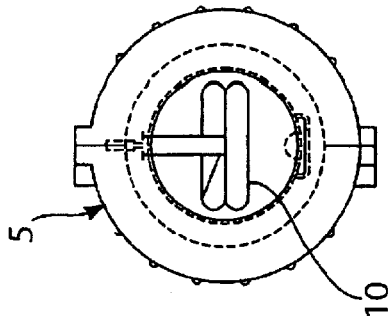
FIG. 3 is a right elevational view of the heater of FIG. 1.
Figure 2:
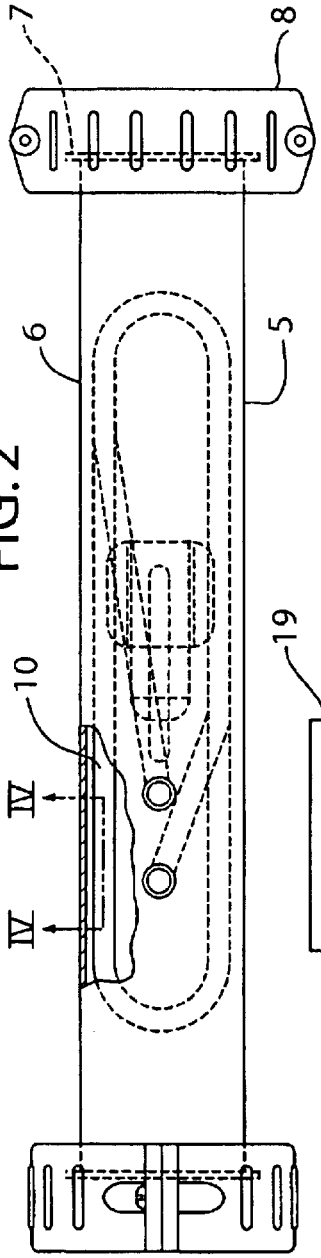
FIG. 2 is a partially fragmentary, top view of the electrical heater of FIG. 1.
Figure 1:
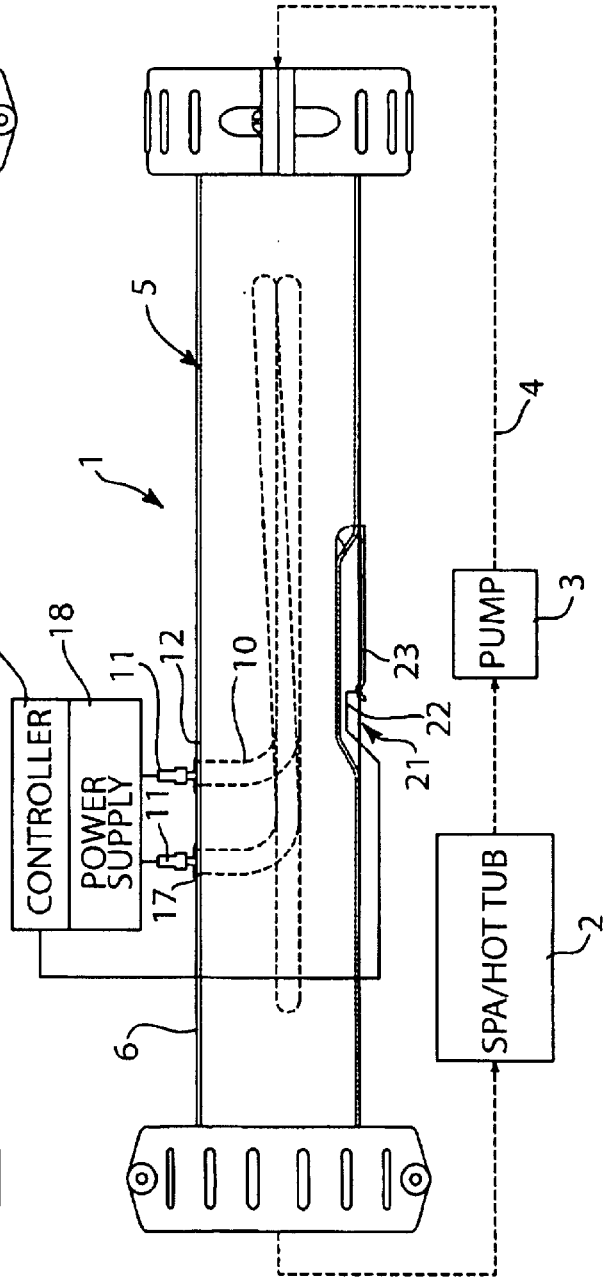
FIG. 1 is a partially schematic front elevational view of an electrical heater according to one aspect of the present invention.

"horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
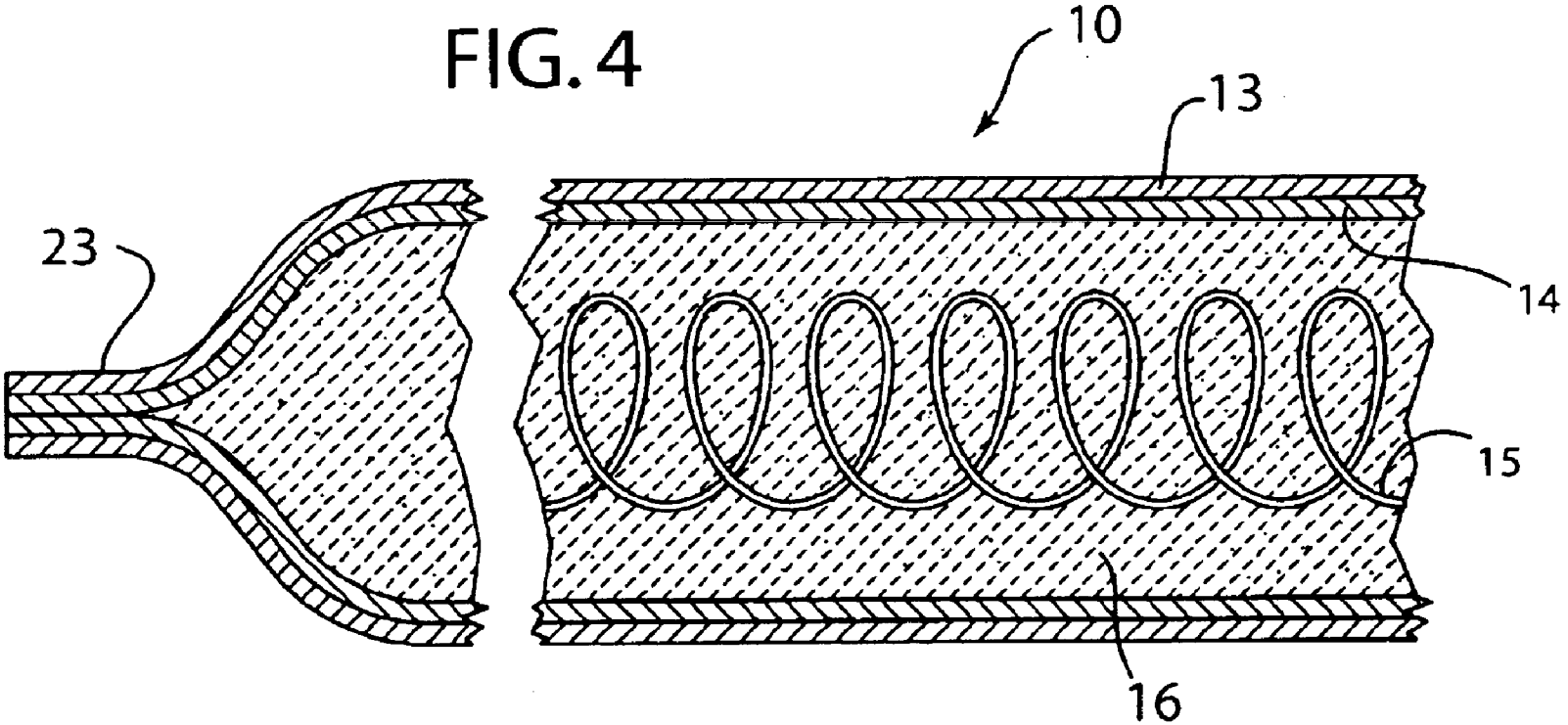
FIG. 4 is a cross-sectional view of the heating element of FIG. 2, taken along the line IV—IV.

With reference to FIG. 1, a spa system 1 according to one aspect of the present invention includes a pool/spa/hot tub 2, an electrical pump 3, an electrical heater 5, and tubing 4 interconnecting the components of the spa system to provide circulation of water therethrough. The electrical heater 5 includes a titanium tubular housing 6 having an outer diameter in the range of about 1-½ inches to 3 inches. In the illustrated example, tubular housing 6 has an outer diameter of 2.25 inches. Tubular housing 6 includes flanges 7 at opposite ends thereof to retain couplers 8 for connection to the tubing 4 or other spa components. An elongated electrical heating element 10 includes electrical connectors 11 that extend through a wall portion 12 of tubular housing 6. With further reference to FIG. 4, electrical heating element 10 has an outer sheath 13 made of a titanium material, and an inner sheath 14 made of a stainless steel material. An electrical resistance line 15 is made of a material such as nickel chromium, or the like, and is disposed within the inner sheath 14 and connected to the electrical connectors 11 at opposite ends thereof. The electrical heating element 10 includes a dielectric material such as magnesium oxide powder 16 disposed within the inner sheath 14 around the electrical resistance line 15 to facilitate heat transfer from the electrical resistance line 15 to the inner sheath 14, outer sheath 13, and the water flowing through the housing 6.

Electrical connectors 11 (FIG. 1) extend through flared openings 17 in tubular housing 6. Because the outer sheath 13 of electrical heating element 10 is made of a titanium material, the electrical heating element 10 can be welded at the flared openings 17 of housing 6, thereby providing a durable leakproof connection. The electrical connectors 11 are operably connected to a power supply 18 that receives signals from a connector 19. Housing 6 includes an indented portion 21 that receives a temperature sensor 20. The temperature sensor 20 is retained in the indentation 21 against the housing 6 by a flexible metal cover 22 that is tack welded to housing 6. The temperature sensor 20 is in contact with the housing 6, such that the temperature of the water flowing through the housing 6 can be sensed. Temperature sensor 20 is operatively connected to controller 19, and the controller 19 is programmed to control the electric heating element in a known manner. An example of one such arrangement is disclosed in U.S. Pat. No. 6,080,973 entitled "ELECTRIC WATER HEATER" filed on Apr. 19, 1999, the entire contents of which is hereby incorporated by reference.

With further reference to FIG. 4, the stainless steel inner sheath 14 is first fabricated with the electrical resistance wire 15 and dielectric material 16 disposed therein according to known methods. The titanium outer sheath or sleeve 13 is then placed over the stainless steel inner sheath 14 and roll reduced in a standard rolling mill to provide a tight fit resulting in a high rate of heat transfer between the inner sheath 14 and outer sheath 13. Prior to roll reduction, the end 23 of sheaths 13 and 14 is tightly crimped to eliminate relative motion between the sheaths 13 and 14 to ensure proper roll reduction. The roll reduction and tight fit of the outer sheath 13 causes the outer sheath 13 to experience hoop stress, thus ensuring that contact is maintained between the outer sheath 13 and inner sheath 14. The magnesium oxide or other powder 16 is tightly compacted to provide heat transfer from the electrical resistance heater line 15 to the inner sheath 14. Although the titanium outer sheath 13 will stress relief slightly at higher temperatures, such as 1000° F., the stainless steel inner sheath 14 will not stress relief in this manner, thereby maintaining the compaction of the dielectric material 16 and proper heat transfer. In a preferred example, stainless inner sheath 14 has a thickness of 0.020 inches, and outer titanium sheath 13 has a thickness of 0.035 inches. The inner sheath 14 and outer sheath 13 may have thicknesses in the range of about 0.015–0.050 inches.

Thus, the electric heating element 10 is very corrosion resistant, yet maintains proper heat transfer through the dielectric material 16. Furthermore, because the outer sheath 13 is made of a titanium material, the electric heating element 10 can be welded to the titanium housing 6, thus providing a secure, leakproof connection.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An electrical heater for fluid, comprising:

a generally tubular housing having a wall portion made of a titanium material; and an elongated electrical heating element having electrical connectors on opposite ends thereof extending through said wall portion, said electrical heating element having an outer sheath made of a titanium material, and an inner sheath made of a stainless steel material, said titanium outer sheath being tightly fitted around said stainless steel inner sheath, said electrical heating element having an electrical resistance line disposed within said inner sheath and connected to said electrical connectors at opposite ends thereof, said electrical heating element including a dielectric material disposed within said inner sheath around said electrical resistance line to facilitate heat transfer from said electrical resistance line to said inner sheath.

2. The electrical heater set forth in claim 1, wherein: said outer sheath of said electrical heating element is welded to said wall portion of said tubular housing adjacent opposite ends of said electrical heating element.

3. The electrical heater set forth in claim 2, wherein:

said wall portion includes a pair of openings therethrough that receive opposite end portions of said electrical heating element, said openings flared to form a contact surface engaging said outer sheath of said electrical heating element.

4. The electrical heater set forth in claim 3, wherein:

said housing includes couplers on opposite ends thereof adapted for leakproof connection of said housing to associated spa components.

5. The electrical heater set forth in claim 4, wherein:

said housing defines an axis; and said electrical heating element forms an elongated loop extending along said axis.

6. The electrical heater set forth in claim 5, wherein:

said housing has an outer diameter in the range of about one and one half inches to three inches; and said electrical heating element has an outer diameter in the range of about two tenths of an inch to about one half inch.

7. The electrical heater set forth in claim 1, wherein: said dielectric material is magnesium powder.

8. An electrical heater, comprising:

a tubular housing having a wall made of a titanium material, said housing having connectors at opposite ends adapted to connect to tubing of a spa system;

a heating element having an outer sheath made of a titanium material, and an inner sheath made of a stainless steel material, said titanium outer sheath being tightly fitted around said stainless steel inner sheath, said electrical heating element having an electrical resistance line disposed within said inner sheath, said electrical resistance line defining opposite ends, said electrical heating element including a dielectric powder disposed within said inner sheath around said electrical resistance line, said outer sheath and said inner sheath compressing said dielectric powder around said electrical resistance line, said electrical heating element having a curved portion forming a loop, said inner and outer sheaths having electrical connectors at opposite ends coupled to said opposite ends of said electrical resistance line and extending through said wall of said housing.

9. The electrical heater set forth in claim 8, wherein: said electrical resistance line is made of a metal material.

10. The electrical heater set forth in claim 7, wherein:

said loop has an elongated U-shaped portion, said opposite ends of said sheaths extending transverse relative to said elongated U-shaped portion.

11. The electrical heater set forth in claim 8, wherein:

said outer sheath has a wall thickness in the range of about 0.015 inches to 0.050 inches.

12. The electrical heater set forth in claim 11, wherein:

said inner sheath has a wall thickness in the range of about 0.015 inches to 0.050 inches.

13. A method of fabricating an electrical heating element, comprising:

providing an electrical resistance heating line;

placing said electrical resistance heating line in a stainless steel sheath;

positioning dielectric powder around said electrical resistance heating line;

placing a titanium sheath over said stainless steel sheath; and simultaneously compacting said titanium and stainless steel sheaths to compress said dielectric powder around said heating line wherein at least one of said titanium sheath and said stainless steel sheath are deformed prior to compaction to prevent movement of said titanium sheath relative to said stainless steel sheath such that said titanium outer sheath is tightly fitted around said stainless steel inner sheath.

14. The method set forth in claim 13, wherein:

said titanium and stainless steel sheaths are compressed by rolling.

15. The method set forth in claim 14, wherein:

said sheaths are compressed sufficiently to maintain compaction of said magnesium powder when said electrical heating element reaches a temperature of at least about one thousand degrees Fahrenheit.

16. The method set forth in claim 14, wherein:

said inner and outer sheaths each have a generally circular cross sectional shape, the inner surface of said outer sheath tightly contacting the outer surface of said inner sheath.

17. An electrical heater, comprising:

a tubular housing having a wall made of a titanium material, said housing having connectors at opposite ends adapted to connect to tubing of a spa system;

a heating element having an outer sheath made of a titanium material, and an inner sheath made of a stainless steel material, said electrical heating element having an electrical resistance line disposed within said inner sheath, said electrical heating element including a dielectric powder disposed within said inner sheath around said electrical resistance line, said outer sheath and said inner sheath compressing said dielectric powder around said electrical resistance line, said outer sheath fitting tightly around said inner sheath to provide heater transfer, said inner and outer sheaths having opposite ends with an electrical connector at each end coupled to said electrical resistance line, said electrical heating element having an elongated central portion, and opposite end portions extending transverse to said central portion through said wall of said housing.

18. The electrical heater set forth in claim 17, wherein:

said electrical resistance line is made of a metal material.

19. The electrical heater set forth in claim 18, wherein:

said outer sheath of said electrical heating element has a circular cross sectional shape.

20. The electrical heater set forth in claim 19, wherein:

said outer sheath has a wall thickness in the range of about 0.015 inches to 0.050 inches.

21. A spa system, comprising:

a container adapted to hold water for immersion of a user;

an electrical water heater;

a pump;

a fluid conduit system interconnecting said container, electrical water heater, and said pump to permit fluid flow through said spa system, said electrical water heater including:

a generally tubular housing having a wall portion made of a titanium material; and an elongated electrical heating element having electrical connectors on opposite ends thereof extending through said wall portion, said electrical heating element having an outer sheath made of a titanium material, and an inner sheath made of a stainless steel material, said titanium outer sheath being tightly fitted around said stainless steel inner sheath, said electrical heating element having an electrical resistance line disposed within said inner sheath and connected to said electrical connectors at opposite ends thereof, said electrical heating element including a dielectric material disposed within said inner sheath around said electrical resistance line to facilitate heat transfer from said electrical resistance line to said inner sheath.

* * * * *